US010426262B2

(12) United States Patent
Robinson et al.

(10) Patent No.: US 10,426,262 B2
(45) Date of Patent: Oct. 1, 2019

(54) CANTILEVER SHELVING SYSTEM

(71) Applicant: InterMetroIndustries Corporation, Wilkes-Barre, PA (US)

(72) Inventors: Todd Robinson, Nazareth, PA (US); Sushant Ramchandra Parekar, Pune (IN)

(73) Assignee: INTERMETRO INDUSTRIES CORPORATION, Wilkes-Barre, PA (US)

( * ) Notice: Subject to any disclaimer, the term of this patent is extended or adjusted under 35 U.S.C. 154(b) by 0 days.

(21) Appl. No.: 16/010,857

(22) Filed: Jun. 18, 2018

(65) Prior Publication Data

US 2018/0295983 A1 Oct. 18, 2018

Related U.S. Application Data

(63) Continuation of application No. 15/884,523, filed on Jan. 31, 2018, now Pat. No. 10,021,972.

(30) Foreign Application Priority Data

Feb. 17, 2017 (IN) ..... 01721005649

(51) Int. Cl.
*A47B 47/02* (2006.01)
*A47B 57/48* (2006.01)
(Continued)

(52) U.S. Cl.
CPC ..... *A47B 47/022* (2013.01); *A47B 47/028* (2013.01); *A47B 57/30* (2013.01);
(Continued)

(58) Field of Classification Search
CPC ..... A47B 57/06; A47B 47/022; A47B 47/028; A47B 57/487; A47B 96/061; A47B 57/30;
(Continued)

(56) References Cited

U.S. PATENT DOCUMENTS 291,030 A 1/1884 Clapper
309,360 A 12/1884 Roberts
(Continued)

FOREIGN PATENT DOCUMENTS

DE 2824605 A1 12/1979
DE 20215552 U1 2/2003
(Continued)

OTHER PUBLICATIONS

Sep. 6, 2016 Freestyle Modular Cantilever Shelving System by SPG—9 page specification.
(Continued)

*Primary Examiner* — Jonathan Liu
*Assistant Examiner* — Devin K Barnett
(74) *Attorney, Agent, or Firm* — Harness, Dickey & Pierce, P.L.C.

(57) ABSTRACT

A cantilever shelving system is disclosed and can include a frame structure, a cantilever shelf support structure, and a plurality of load-bearing shelves that can be supported by the cantilever shelf support structure and the frame structure. The shelves can be positioned laterally adjacent to cantilever support arms of the cantilever shelf support structure, and the shelf support surfaces can be coplanar with upper walls of the cantilever support arms. Ends of laterally adjacent shelves do not overlap with a front side of a vertical support member to which the cantilever support arm is mounted. The cantilever shelving system can accommodate various user requirements and can be operably integrated with standard commercial and/or industrial equipment or machinery.

27 Claims, 9 Drawing Sheets

(51) Int. Cl.

| | |
|---|---|
| ***A47B 96/06*** | (2006.01) |
| ***A47B 57/30*** | (2006.01) |
| ***A47B 96/02*** | (2006.01) |
| *A47B 57/06* | (2006.01) |
| *A47F 5/10* | (2006.01) |
| *A47B 57/40* | (2006.01) |
| *A47B 91/00* | (2006.01) |
| *A47B 96/14* | (2006.01) |

(52) U.S. Cl.
CPC ..... *A47B 57/487* (2013.01); *A47B 96/028* (2013.01); *A47B 96/061* (2013.01); *A47B 57/06* (2013.01); *A47B 57/402* (2013.01); *A47B 57/485* (2013.01); *A47B 91/00* (2013.01); *A47B 96/14* (2013.01); *A47F 5/103* (2013.01)

(58) Field of Classification Search
CPC ... A47B 96/028; A47B 57/402; A47B 57/485; A47B 91/00; A47B 96/14; A47C 19/20; A47C 19/22; A47C 19/207; A47C 19/205
USPC ..... 211/90.01–90.03, 186, 187, 188, 134; 248/236, 235, 240–247, 250.678, 346.01; 108/106–108, 147.11; 5/2.1, 8, 9.1
See application file for complete search history.

(56) References Cited

U.S. PATENT DOCUMENTS 310,343 A * 1/1885 Warren ..... A47C 19/122 5/152
324,775 A * 8/1885 Jones ..... A47C 19/22 5/2.1
663,784 A 12/1900 Porter
870,439 A 11/1907 Kade
1,560,122 A 11/1925 Vance
1,582,100 A 4/1926 Troppman
1,620,841 A 3/1927 Vance
1,698,974 A 1/1929 Vance
1,983,858 A 12/1934 Karnes
2,008,180 A 7/1935 Karnes
2,504,800 A * 4/1950 Campagna ..... F16M 11/125 248/148
2,534,952 A 12/1950 Corner
2,632,645 A * 3/1953 Barkschat ..... A63B 3/00 108/39
2,693,884 A 11/1954 Gurries
2,772,846 A 12/1956 Skar
2,912,119 A 11/1959 Robinson
2,919,034 A 12/1959 Levy
2,933,196 A 4/1960 Louis
2,940,603 A 6/1960 Riedmaier
2,971,805 A 2/1961 Weiss
2,975,908 A 3/1961 Huet
2,983,389 A 5/1961 Trautmann
3,018,900 A 1/1962 Huet
RE25,156 E 4/1962 Gingher
3,040,905 A 6/1962 Gingher et al.
3,044,632 A 7/1962 Schild
3,044,634 A 7/1962 Oztekin
3,057,483 A 10/1962 Derman
3,097,822 A * 7/1963 Attwood ..... A47B 57/045 248/250
3,127,146 A 3/1964 Fisher
3,130,693 A 4/1964 Shell
3,184,068 A 5/1965 Wende
3,199,822 A 8/1965 Ruhnke
3,207,322 A 9/1965 Pedersen
3,212,648 A 10/1965 Baker, Jr. et al.
3,216,377 A 11/1965 Gunn
3,221,678 A 12/1965 Doherty
3,229,822 A 1/1966 Janus
3,316,863 A 5/1967 Zock
3,471,112 A 10/1969 Macdonald
3,512,654 A 5/1970 Olsen et al.
3,556,306 A 1/1971 Irving
3,565,020 A 2/1971 Robert et al.
3,587,867 A 6/1971 Fenwick
3,595,404 A 7/1971 Goldstein et al.
3,602,159 A 8/1971 Marschak
3,602,374 A 8/1971 Alabaster
3,612,291 A 10/1971 Skubic
3,645,486 A 2/1972 Ferdinand et al.
3,695,569 A 10/1972 Pullan
3,701,325 A 10/1972 Fenwick
3,722,702 A * 3/1973 Marker, Jr. ..... A47F 5/13 108/115
3,730,108 A 5/1973 Stroh
3,759,191 A 9/1973 Freeman
3,765,344 A 10/1973 Ferdinand et al.
3,827,377 A 8/1974 Aughtry, Jr.
3,854,686 A 12/1974 Konstant
4,018,167 A 4/1977 Spangler
4,064,996 A 12/1977 Shillum
4,093,078 A * 6/1978 Radek ..... A47F 5/103 211/182
4,098,480 A 7/1978 Neumann
4,101,108 A 7/1978 Klein
4,197,950 A 4/1980 Ovitz, III
4,230,052 A 10/1980 Champagne
4,286,719 A 9/1981 Hall
4,312,086 A 1/1982 Bianco
4,332,204 A 6/1982 Hewell
4,360,181 A 11/1982 Burkholder
4,378,925 A 4/1983 Griffin
4,390,302 A 6/1983 Sanfeliu-Marimon
4,396,125 A 8/1983 Rowader
4,397,432 A 8/1983 Resetar
4,444,323 A 4/1984 Travis
4,592,286 A 6/1986 Trubiano
4,619,427 A * 10/1986 Leymann ..... F16M 11/048 108/102
4,624,376 A 11/1986 Bertram
4,938,442 A 7/1990 Mastrodicasa
4,951,908 A 8/1990 Kallio
4,960,210 A 10/1990 Spamer
5,022,541 A 6/1991 White
5,054,404 A 10/1991 Melgers
5,074,422 A 12/1991 Holtz
D331,873 S 12/1992 Finkelstein et al.
5,269,419 A 12/1993 Aldeguer et al.
5,297,486 A 3/1994 Herrmann et al.
5,350,074 A 9/1994 Rosen Band
5,365,860 A 11/1994 Billington, III
5,405,114 A 4/1995 Dias
D358,321 S 5/1995 Tayar
5,437,426 A 8/1995 MacDonald
5,454,638 A 10/1995 Bird et al.
5,456,435 A 10/1995 Sweeney
5,472,103 A 12/1995 Merl
5,482,168 A 1/1996 Welch et al.
5,522,324 A 6/1996 van Gelder et al.
5,531,168 A 7/1996 Towfigh
5,592,886 A 1/1997 Williams et al.
5,605,238 A 2/1997 Jacobs
5,611,440 A 3/1997 Mçller
5,613,449 A 3/1997 Pullman
5,645,257 A 7/1997 Ward
5,655,740 A 8/1997 Lazarus
5,695,163 A 12/1997 Tayar
5,794,902 A 8/1998 Henry et al.
5,797,501 A 8/1998 Von Gunten
5,833,083 A 11/1998 Miller
5,868,263 A 2/1999 McAllister et al.
5,908,119 A 6/1999 Kump et al.
5,921,190 A 7/1999 Wood
5,921,414 A 7/1999 Burke et al.
D415,365 S 10/1999 Nicklas
5,979,677 A 11/1999 Simpson, II et al.
6,024,333 A 2/2000 Raasch et al.
6,029,833 A 2/2000 Yeh
6,053,115 A 4/2000 Felton

(56) References Cited

U.S. PATENT DOCUMENTS

| | | | | |
|---|---|---|---|---|
| 6,062,401 | A | 5/2000 | Hall et al. | |
| 6,082,690 | A | 7/2000 | Durin et al. | |
| 6,109,461 | A | 8/2000 | Kluge et al. | |
| 6,129,224 | A | 10/2000 | Mingers | |
| 6,158,599 | A | 12/2000 | Lazarus | |
| 6,230,907 | B1 | 5/2001 | Stuart | |
| 6,267,064 | B1 | 7/2001 | Ostertag et al. | |
| 6,269,906 | B1 | 8/2001 | Dockter et al. | |
| 6,302,283 | B1 | 10/2001 | Yeh | |
| 6,345,795 | B1 | 2/2002 | Bartz, Jr. | |
| D462,541 | S | 9/2002 | Welch | |
| 6,460,946 | B1 | 10/2002 | Beukema | |
| 6,584,916 | B1 | 7/2003 | Felton et al. | |
| 6,666,344 | B1 | 12/2003 | Schneider | |
| 6,675,725 | B2 | 1/2004 | Felton et al. | |
| 6,721,969 | B1 * | 4/2004 | Lupo | A47C 17/86 5/9.1 |
| RE38,517 | E | 5/2004 | Pfeiffer et al. | |
| 6,880,185 | B1 * | 4/2005 | McAdams | A47B 85/00 5/10.1 |
| 6,918,499 | B2 | 7/2005 | De Land et al. | |
| 7,036,160 | B1 * | 5/2006 | Pecoraro | A47B 83/04 108/49 |
| 7,191,908 | B2 | 3/2007 | De Rijk | |
| 7,240,803 | B2 | 7/2007 | Stitchick et al. | |
| 7,258,317 | B1 | 8/2007 | Nagel | |
| 7,407,060 | B2 | 8/2008 | Swartz et al. | |
| 7,494,019 | B2 | 2/2009 | Kessell et al. | |
| 7,497,344 | B2 | 3/2009 | Chen | |
| 7,523,903 | B1 | 4/2009 | Rindoks et al. | |
| 7,900,783 | B2 | 3/2011 | Fernandez et al. | |
| 8,028,846 | B2 | 10/2011 | Peota et al. | |
| D702,467 | S | 4/2014 | Huang et al. | |
| 8,967,576 | B2 | 3/2015 | Knoll et al. | |
| 9,119,471 | B2 | 9/2015 | Gonzalez et al. | |
| 9,277,814 | B2 | 3/2016 | Winker | |
| 9,339,108 | B2 | 5/2016 | Zang et al. | |
| 9,770,122 | B2 | 9/2017 | Gonzalez et al. | |
| D808,200 | S | 1/2018 | Davis et al. | |
| 9,883,755 | B2 | 2/2018 | Gonzalez et al. | |
| 2003/0037712 | A1 | 2/2003 | Welch et al. | |
| 2003/0160012 | A1 | 8/2003 | Kanouchi et al. | |
| 2003/0233965 | A1 * | 12/2003 | Brazier | A47B 96/028 108/108 |
| 2003/0234231 | A1 * | 12/2003 | Rowe | A47B 57/30 211/90.02 |
| 2004/0045919 | A1 | 3/2004 | Remmers | |
| 2004/0050814 | A1 | 3/2004 | Roush et al. | |
| 2004/0154498 | A1 | 8/2004 | Borgen et al. | |
| 2004/0159622 | A1 | 8/2004 | Craft et al. | |
| 2004/0173549 | A1 | 9/2004 | Herron et al. | |
| 2004/0182805 | A1 | 9/2004 | Harper | |
| 2005/0045787 | A1 | 3/2005 | Magnusson | |
| 2005/0092706 | A1 | 5/2005 | Chang | |
| 2005/0103733 | A1 | 5/2005 | Saltzberg et al. | |
| 2005/0103734 | A1 | 5/2005 | Saltzberg et al. | |
| 2005/0127017 | A1 | 6/2005 | Kessel et al. | |
| 2005/0145588 | A1 | 7/2005 | Stitchick et al. | |
| 2005/0150850 | A1 | 7/2005 | Stitchick et al. | |
| 2005/0199568 | A1 | 9/2005 | Gay et al. | |
| 2006/0175495 | A1 | 8/2006 | Gregory | |
| 2006/0213849 | A1 | 9/2006 | Bienick | |
| 2007/0241072 | A1 * | 10/2007 | Bryant | A47B 96/021 211/90.02 |
| 2007/0295681 | A1 | 12/2007 | Colin | |
| 2008/0047914 | A1 | 2/2008 | Young | |
| 2008/0217496 | A1 | 9/2008 | Wooten | |
| 2010/0096529 | A1 * | 4/2010 | Kritsky | E06B 3/44 248/407 |
| 2010/0140202 | A1 | 6/2010 | Janis | |
| 2010/0155353 | A1 | 6/2010 | McAllister et al. | |
| 2010/0269254 | A1 * | 10/2010 | Sanders, Jr. | A47C 19/20 5/2.1 |
| 2012/0055897 | A1 * | 3/2012 | Li | A47B 5/06 211/149 |
| 2012/0175330 | A1 | 7/2012 | Nicholls et al. | |
| 2012/0273447 | A1 | 11/2012 | Stitchick et al. | |
| 2013/0000037 | A1 * | 1/2013 | Tabbia | A47D 7/02 5/93.1 |
| 2014/0263125 | A1 * | 9/2014 | Gonzalez | A47B 96/1408 211/134 |
| 2015/0335155 | A1 | 11/2015 | Winker | |
| 2016/0015174 | A1 | 1/2016 | Guizzardi et al. | |
| 2017/0310090 | A1 | 10/2017 | Woodley et al. | |
| 2017/0340142 | A1 | 11/2017 | Gonzalez et al. | |

FOREIGN PATENT DOCUMENTS

| | | | |
|---|---|---|---|
| GB | 608480 | A | 9/1948 |
| WO | WO-95/029613 | A1 | 11/1995 |
| WO | WO-03/088782 | A2 | 10/2003 |
| WO | WO-2013/071977 | A1 | 5/2013 |

OTHER PUBLICATIONS

"Button-On Cantilever Rack"; https://web.archive.org/web/20061019070526/http://www.jarke.com/pro . . . ; Jarke—division of Leggett & Platt; 2006.

"Cantilever Shelving" brochure; Eagle Group; Mar. 2005.

"Cantilever Shelving System—Heavy Duty Components" specification sheet; Eagle Group, Sep. 2010.

"Chapter 3—Installing FlexWorks Accessories"; Lista International Corporation; May 2000.

"FreedomRail Installation Guide"; OrganizedLiving; 2009.

"Shelving and Shelving Solutions" brochure; Eagle Group; Apr. 2009.

"Wire Basket with Brackets 36" × 16""; https://web.archive.org/web/20120507140028/http://www.globalindustria . . . ; Global Equipment Company Inc.; 2012.

"Storage Racks" Standard Product Catalog; SPG International, LLC; 2010.

Extended European Search Report for EP 18156976.5, conducted May 4, 2018, EPO.

Cantilever Shelving Unit Assembly Instructions; Nexel Industries; Circa 2011.

Complaint for Case 3:18-cv-00116 filed Feb. 6, 2018; *SPG International, LLC* vs. *InterMetro Industries Corp*.

Corrosion Resistant Cantilever Rack—Adjustable Width Uprights & Frame (Only); https://www.globalindustrial.com/p/storage/bulk-rack/cantilever/corrosion-resistant-cantilever-rack-upright; Global Industrial website; Circa 2011.

"HD Super Work Center With Overhead" specification sheet; InterMetro Industries Corporation, Sep. 2000.

"Super Erecta Shelf Post—Type and Direct Wall Mounts" specification sheet; InterMetro Industries Corporation, Apr. 2011.

"Metro WorkSpace™ Adjustable Workstations"; InterMetro Industries Corp.; 2001.

* cited by examiner

CANTILEVER SHELVING SYSTEM

CROSS-REFERENCE TO RELATED APPLICATIONS

This application is a continuation of U.S. patent application Ser. No. 15/884,523 filed on Jan. 31, 2018, which claims the benefit and priority of IN201721005649, filed Feb. 17, 2017. The entire disclosures of the above applications are incorporated herein by reference.

FIELD

The present disclosure relates to cantilever shelving systems and storage rack assemblies.

BACKGROUND

This section provides background information related to the present disclosure which is not necessarily prior art.

Cantilever shelving systems and storage rack assemblies are readily adaptable for supporting and storing a variety of items and have found widespread use in industrial, commercial and residential applications.

Many existing cantilever shelving systems and storage rack assemblies include frames and shelves having fixed dimensions in well-known standard sizes which cannot be adapted or modified to accommodate various and changing customer requirements. Further, known shelving units do not readily accommodate integration with standard-sized industrial and/or commercial equipment with which the shelving system may be associated during use. Consequently, these shelving systems and storage rack assemblies offer limited flexibility in configuration and use.

SUMMARY

This section provides a general summary of the disclosure, and is not a comprehensive disclosure of its full scope or all of its features.

A cantilever shelving system is disclosed and can include a frame structure, a cantilever shelf support structure, and a plurality of load-bearing shelves that can be supported by the cantilever shelf support structure and the frame structure. The shelves can be positioned laterally adjacent to cantilever support arms of the cantilever shelf support structure, and the shelf support surfaces can be coplanar with upper walls of the cantilever support arms. In addition, ends of laterally adjacent shelves do not overlap with a front side of a vertical support member to which the cantilever support arm is mounted.

In one aspect of the disclosure, the cantilever shelving system can include a frame structure comprising a plurality of vertical support members, a lateral support structure interconnecting the vertical support members, and a base. The cantilever shelf support structure can be mounted to the frame structure. A plurality of generally rectangular, load-bearing shelves supported by the cantilever shelf support structure and the frame structure are provided and each of the shelves can include an upper support surface and a plurality of mounting collars located near each corner of the shelf.

In another aspect of the disclosure, the cantilever shelf support structure can include a plurality of horizontally extending cantilever support arms, and at least one cantilever support arm can be mounted to each of the vertical support members and a plurality of shelf support fittings that can be mounted to each of the cantilever support arms.

In still another aspect of the disclosure, the cantilever support arm can include an elongated portion extending from a proximal end to a distal end along a longitudinal axis and having a planar upper wall and opposing side walls. A mounting flange can be located at the proximal end and include opposing side braces spaced laterally apart to enable the mounting flange to closely fit on a vertical support member. At least two slots can be included in each of the side walls, and at least one slot is near the proximal end and at least one slot is near the distal end. The shelf support fitting can include a mounting portion including at least one mounting tab and at least one lock notch, and a support portion having an upward projection laterally offset from the mounting portion. The mounting tab can be inserted into one of the slots and can engage an inside surface of a side wall of the cantilever support arm above the one slot. The lock notch can engage a lower end of the slot. The mounting collars of the load-bearing shelves can engage the upward projections of the shelf support fittings.

In yet another aspect of the disclosure, the base of the frame structure can include a plurality of base supports, with at least two base supports attached, respectively, to at least two vertical support members near a lower vertical end of the vertical support member and form an angle of approximately ninety degrees with the vertical support member. The base supports can include a horizontal support leg extending along a longitudinal axis from a proximal end adjacent to the vertical support member to a distal end, and can have an upper side. A vertical support foot can extend vertically downward from the distal end of the horizontal support leg.

In yet another aspect of the disclosure, a plurality of first base supports can be positioned on the vertical support member at a first vertical height so that the upper sides of the horizontal support legs of the plurality of first base supports lie in a first horizontal plane above a support surface. Further, at least one second base support can be positioned on the vertical support member at a second vertical height so that the upper side of the horizontal support leg of the at least one second base support lies in a second horizontal plane above the support surface. The second horizontal plane can be beneath the first horizontal plane.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
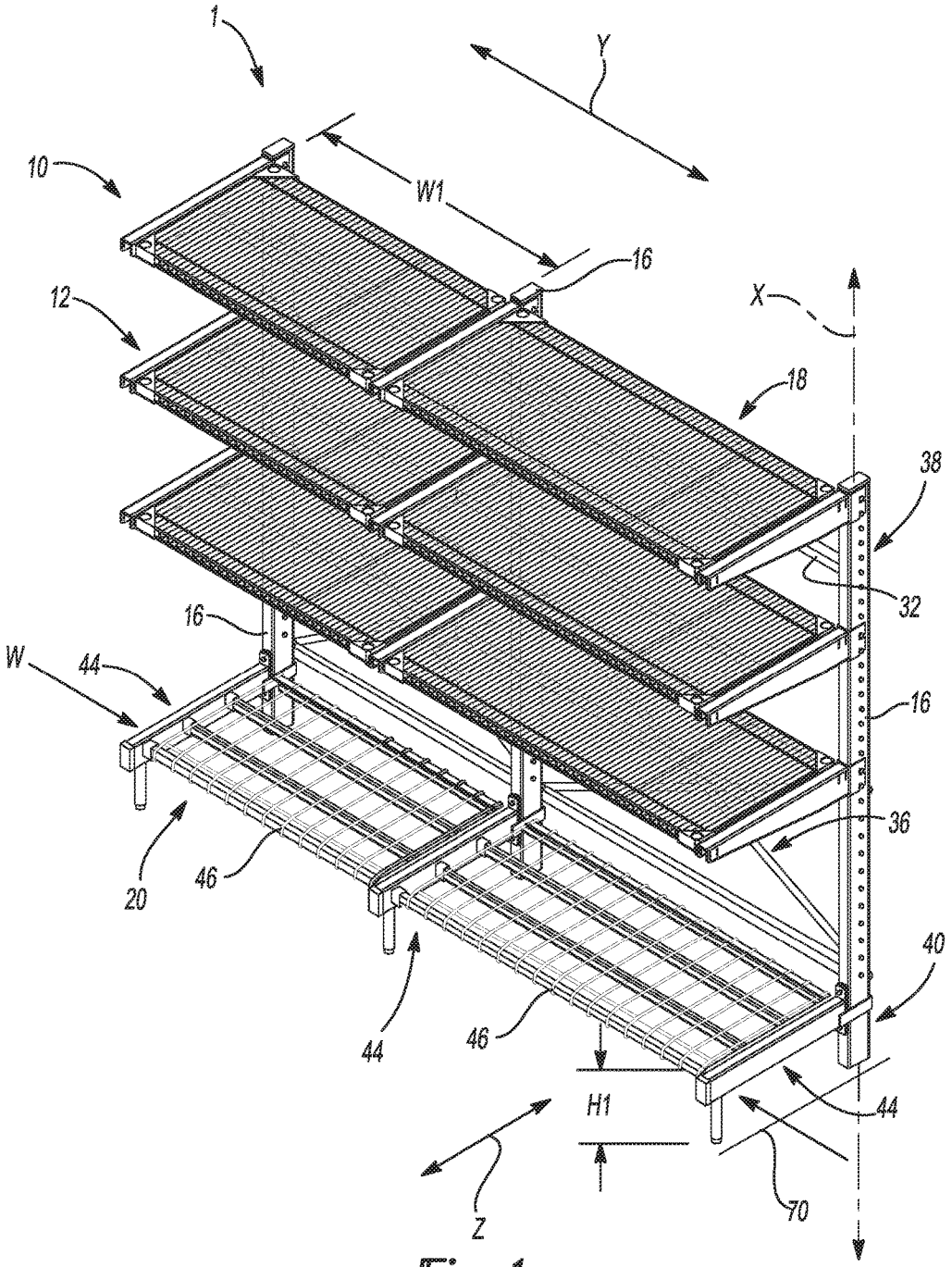
FIG. 1 shows a perspective view of an exemplary cantilever shelving system according to the principles of the present disclosure.

Example embodiments will now be described more fully with reference to the accompanying drawings.

An exemplary cantilever shelving system 1 according to the principles of the present disclosure is shown and understood with reference to FIGS. 1-11. The cantilever shelving system 1 of the present disclosure can provide multiple, vertically-arranged and horizontally-oriented load-bearing platforms for supporting and/or storing items in a workspace or storage area. The cantilever shelving system 1 of the present disclosure can be easily adapted or modified to accommodate various and changing user requirements, and can readily accommodate operable integration with standard-sized industrial and/or commercial equipment with which the shelving system may be associated during use.

With reference to the figures, the cantilever shelving system 1 of the present disclosure can generally include a frame structure 10, a cantilever shelf support structure 12, and a plurality of load-bearing shelves 14 that can be supported by the cantilever shelf support structure 12 and the frame structure 10.

The frame structure 10 can generally include at least two vertically-oriented or upright support members 16, a lateral support structure 18 interconnecting the upright support members 16, and a base 20.

Figure 2:
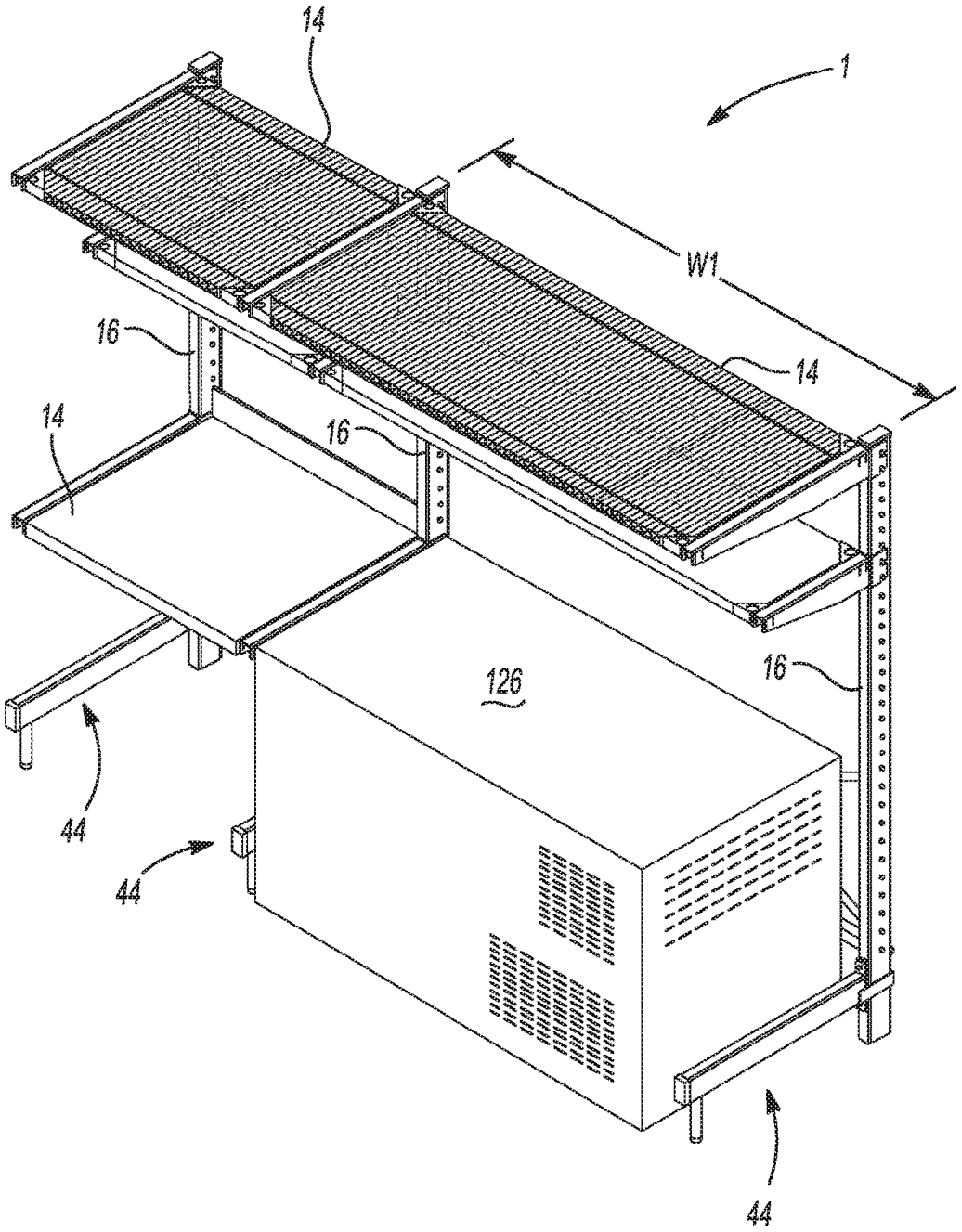
FIG. 2 shows a perspective view of another exemplary cantilever shelving system according to the principles of the present disclosure and including a piece of equipment operably integrated therewith.
Figure 9:
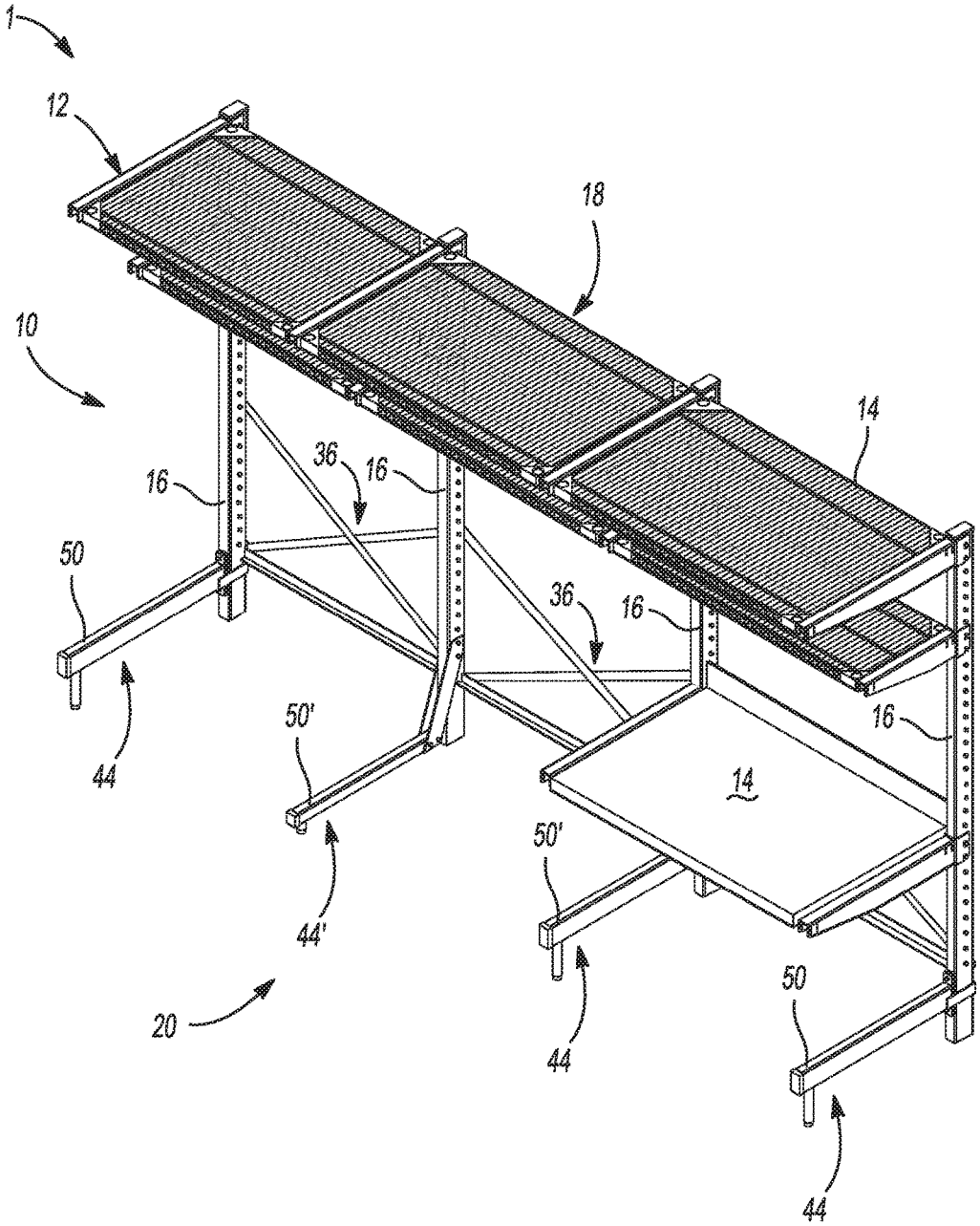
FIG. 9 shows a perspective view of another exemplary cantilever shelving system including a low-profile base support according to the principles of the present disclosure.

Referring to FIGS. 1, 2, and 9, each of the upright support members or vertical support posts 16 can extend vertically along a longitudinal axis X. In one aspect of the present disclosure, the vertical support posts 16 can incorporate a tubular construction or bar extending along the longitudinal axis X and having an exterior surface. In another aspect, a tubular construction can take the form of a hollow, metal tube having a rectangular cross-section having a front side 22, a back side 24, and opposing lateral sides 26. It can be appreciated, however, that other materials and cross-sectional geometries are contemplated within the scope of the present disclosure. Each vertical support post 16 can include an end cap 28 covering each longitudinal end of the vertical support posts 16.

At least two vertical support posts 16 can be positioned from one another in a laterally spaced-apart relationship along a lateral axis Y to establish a width dimension W of the cantilever shelving system 1. As shown in the exemplary embodiment of the cantilever shelving system 1 of the present disclosure of FIG. 1, the cantilever shelving system 1 can include three vertical support posts 16 positioned in a laterally spaced-apart manner and equidistant from one another. However, it can be understood and appreciated, that a cantilever shelving system 1 according to the principles of the present disclosure can be constructed to any desired width dimension W and include any number of vertical support posts 16 (of at least two or more). Further, the vertical support posts 16 can be laterally space-apart equal or unequal distances, depending on the uses or requirements of the cantilever shelving system 1.

Figure 5:
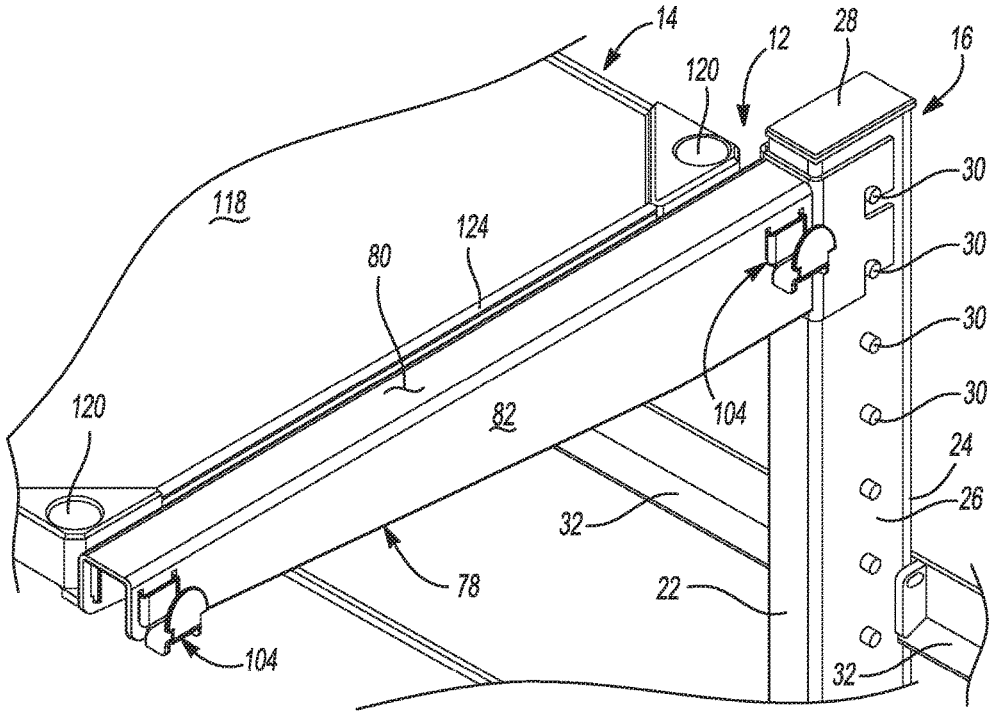
FIG. 5 shows a partial perspective view of the cantilever shelf support structure and load-bearing shelf of the cantilever shelving system of the present disclosure.

As illustrated in FIGS. 1 and 5, each of the vertical support posts 16 can include a plurality of spaced-apart, support members or hanger pins 30 that can protrude or extend outwardly from one or both of the opposing lateral sides 26 of the vertical support posts 16. The hanger pins 30 can be positioned at a plurality of discrete vertical locations in a direction along the longitudinal axis X of the vertical support post 16. The hanger pins 30 can be integrally formed with or fixedly attached to the vertical support posts 16, such as by molding, extruding, forming, mechanical fastening (e.g., threading, interference or deforming), welding, or the like. In one aspect, the hanger pins 30 can exhibit a generally circular, solid cross-section, although cross-sections of other geometries and hollow cross-sections are also contemplated. The hanger pins 30 can protrude from the opposing lateral sides 26 of the vertical support posts 16 so as to be operable to engage the cantilever shelf support structure 12 as will be discussed further herein.

Turning again to FIG. 1, two or more of the vertical support posts 16 can be interconnected to one another by the lateral support structure 18. The lateral support structure 18 can include one or more horizontal crossbars 32. In one aspect of the present disclosure, the horizontal crossbars 32 can have a tubular or bar construction extending along a longitudinal axis and having an exterior surface. In another aspect, a tubular construction can take the form of a hollow, metal tube having a rectangular cross-section having a front side, a back side, and opposing upper and lower sides. It can be appreciated, however, that other materials and cross-sectional geometries are contemplated within the scope of the present disclosure. Each horizontal crossbar 32 can include an end cap (not shown) covering each longitudinal end of the horizontal crossbar 32.

Additionally, or alternatively, the lateral support structure 18 can include one or more cross-braces 36. In one aspect of the present disclosure, the cross-braces 36 can have a stamped, metal construction. However, other materials and configurations are contemplated within the scope of the present disclosure.

The horizontal crossbars 32 can be sized to extend between and/or across some or all of the vertical support posts 16 of the frame structure 10 to laterally interconnect two or more of the vertical support posts 16 together. For example, in one aspect, a horizontal crossbar 32 can be sized to extend between and interconnect two adjacent vertical support posts 16 of the frame structure 10. Alternatively, or in addition, a horizontal crossbar 32 can be sized to extend across and interconnect all of the vertical support posts 16 in the frame structure 10, i.e., across the entire width W of the cantilever shelving system 1. In still another alternative or additional arrangement, a horizontal crossbar 32 can be sized to extend across more than two vertical support posts 16, but less than the entire width W of the shelving system. The horizontal crossbars 32 can be joined or connected to the respective vertical support posts 16 in any of a variety of ways, such as by threaded or deformable fasteners, welding or other similar means.

One or more horizontal crossbars 32 can be positioned at one or more vertical locations along the longitudinal axes X of the vertical support posts 16. In one aspect of the disclosure the cantilever shelving system 1, one or more horizontal crossbars 32 can be included near the upper ends 38 of the vertical support posts 16 and/or a one or more horizontal crossbars 32 can be included near the lower ends 40 of the vertical support posts 16, as shown in FIGS. 1 and 3, for example.

Also as shown in the embodiments of FIGS. 1 and 9, in addition to the one or more horizontal crossbars 32, the lateral support structure of the cantilever shelving system 1 can include one or more cross-braces 36. The cross-braces 36 can include a pair of flat, stamped metal slats or bars 42 arranged in a criss-crossed relationship and fastened or joined to one another at approximately their respective midpoints, such as in a "X" pattern.

The cantilever shelving system 1 can include cross-braces 36 between each of the adjacent pairs of vertical support posts 16, as shown in the figures. As with the horizontal cross bars 32, the cross-braces 36 can be sized to extend between and interconnect two adjacent vertical support posts 16, or some or all of the vertical support posts 16 included in the cantilever shelving system 1. The cross-braces 36 can be joined or connected to the respective vertical support posts 16 in any of a variety of ways, such as by threaded or deformable fasteners, welding or other similar means.

Figure 3:
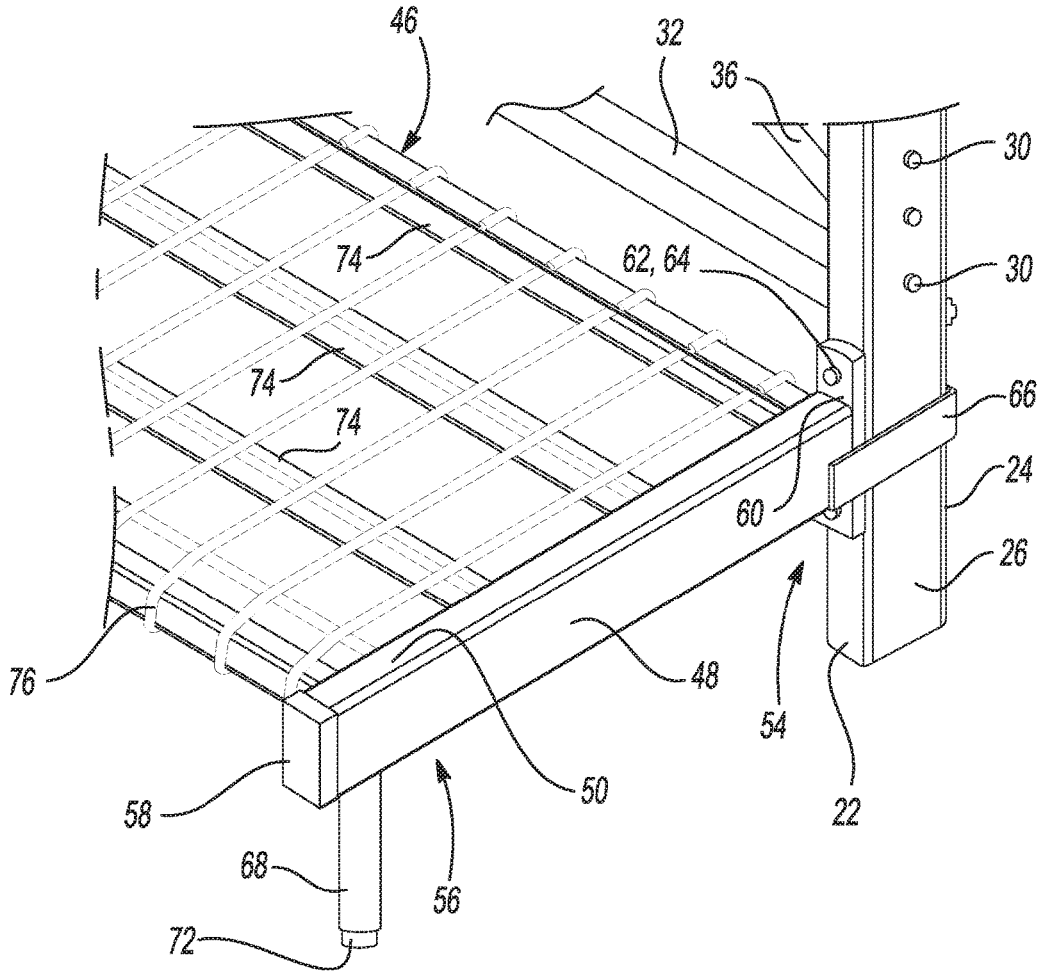
FIG. 3 is an enlarged detail view showing a portion of the base of cantilever shelving system of FIG. 1.
Figure 4:
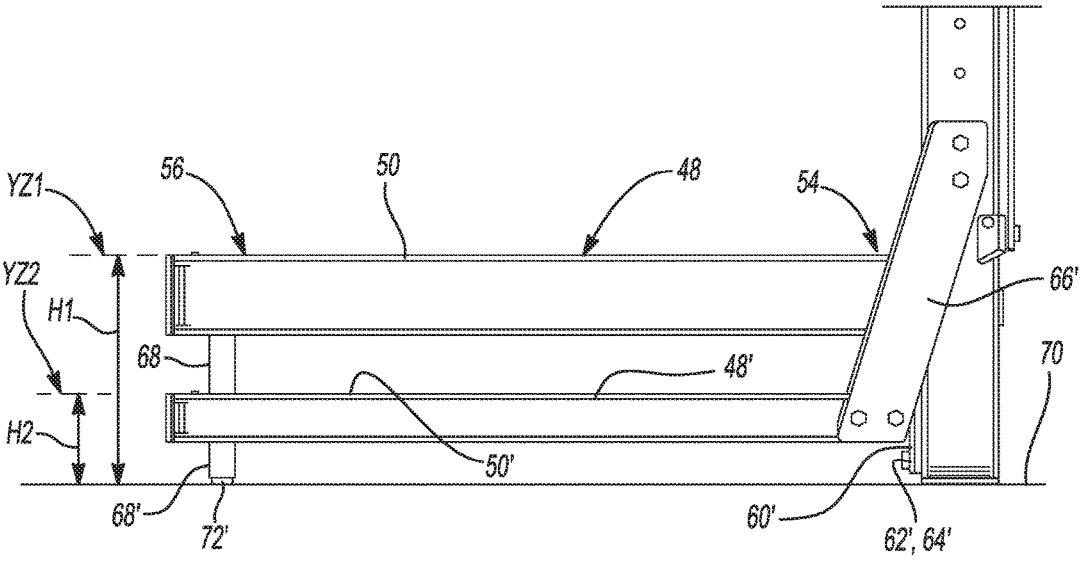
FIG. 4 is a partial side view showing base supports for the cantilever shelving system according to the principles of the present disclosure.

Referring to FIGS. 1, 3 and 4, the frame structure can also include a base 20. The base 20 can include a plurality base supports 44 and one or more base shelves 46.

Each base support 44 can be associated with and can be attached to a corresponding a vertical support post 16. Therefore, the base 20 of the frame structure 10 can include at least two base supports 44 that can each be associated with the vertical support posts 16 located at opposite lateral ends of the cantilever shelving system 1. Every vertical support post 16, however, may not have a corresponding base support 44 attached thereto. For example, if three vertical support posts 16 are included in the frame structure 10, there may not be a base support 44 attached the vertical support post 16 intermediate the opposite lateral ends of the cantilever shelving system 1.

The base support 44 can include a horizontal support leg 48 which can have a tubular or bar construction having an exterior surface. In another aspect, the tubular construction can take the form of a hollow, metal tube having a rectangular cross-section having an upper side 50, a lower side 52, and opposing lateral sides 54. It can be appreciated, however, that other materials and cross-sectional geometries are contemplated within the scope of the present disclosure. In one aspect of the present disclosure, the horizontal support legs 48 of the base supports 44 can all have the same cross-sectional dimensions. In another aspect of the disclosure, a horizontal support leg 48 of at least one base support 44 can have cross-sectional dimension(s) resulting in a different cross-section than the other horizontal support legs 48 of other base supports 44.

The horizontal support leg 48 can extend along a longitudinal axis Z from a proximal end 54 that is adjacent to the corresponding vertical support post 16 to which it attached, toward a distal or terminal end 56. The horizontal support leg 48 can extend forward from the front side 22 of the corresponding vertical support post 16 such that the horizontal support leg 48 can form an angle of approximately ninety degrees with the vertical support post 16. The terminal end 56 of each horizontal support leg 48 can include an end cap 58.

The horizontal support leg 48 can be attached or connected to a respective vertical support post 16 at its proximal end 54, such as by threaded or deformable fasteners, welding or other means. For example, a flange 60 can be integral with or affixed to (e.g., such as by welding) the proximal end 54 of the horizontal support leg 48. The flange 60 can extend along the front side 22 of the vertical support post 16 above and below the horizontal support leg 48. The flange 60 can include mounting apertures 62. The mounting apertures 62 can accommodate fasteners 64 which can engage the vertical support post 16 to fixedly attach the horizontal support leg 48 to the vertical support post 16. In addition, or alternatively, a mounting strap 66 can be fixedly attached to the lateral sides 54 of the horizontal support leg 48 at the proximal end 54 of the horizontal support leg 48 and extend to the lateral side(s) 26 of the vertical support post 16 to also secure the horizontal support leg 48 to the vertical support post 16.

As shown in FIG. 3, the base support 44 can also include a support foot 68 located at or near the distal end 56 of the horizontal support leg 48. The support foot 68 can extend generally vertically downwardly from the horizontal support leg 48. The support foot 68 can be adjustable in length. For example, the support foot 68 can include a leveler, such as a bolt leveler 72.

The base support 44 can be attached to the vertical support post 16 at or near a lower vertical end of the vertical support post 16. Thus, the base support 44 and the lower end of the vertical support post 16 can cooperate to provide a stable foundation for the cantilever shelving system 1 on the support surface 70 (e.g., a floor) upon which the cantilever shelving system 1 is positioned for use. In one aspect of the disclosure, all of the base supports 44 can be positioned and attached to the vertical support posts 16 at the same vertical height H1, such as shown in FIG. 1. In this configuration, the upper sides 50 of all the horizontal support legs 48 can all be situated in a common i.e., first, horizontal plane YZ1. For example, the base supports 44 can be positioned on the vertical support post 16 such that the upper sides 50 of the horizontal support legs 48 are about 6 to 10 inches above the support surface 70.

Figure 11:
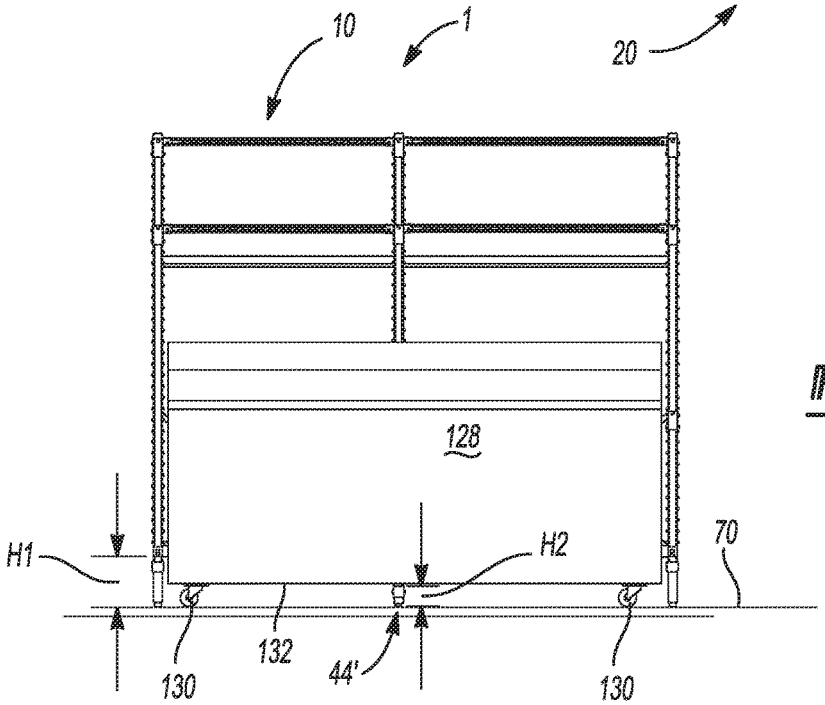
FIG. 11 shows a front view of a cantilever shelving system according to the principles of the present disclosure and including a piece of equipment operably integrated therewith.

In another aspect of the disclosure, as illustrated in FIGS. 4, 9 and 11, at least one base support 44' can be positioned on the vertical support post 16 at a vertical height H2 different than other base supports 44. In such a configuration, the upper side 50' of the horizontal support leg 48' of the one base support 44' lies in a different, i.e., second, horizontal plane YZ2. For example, the second horizontal plane H2 can be vertically lower than the first horizontal plane H1. With reference to FIGS. 4 and 9, an exemplary low-profile base support 44' is shown. The low-profile base support 44' can be positioned on the vertical support post 16 such that the upper side 50' of its horizontal support leg 48' is about 3 to 5 inches above the support surface 70.

Figure 12:
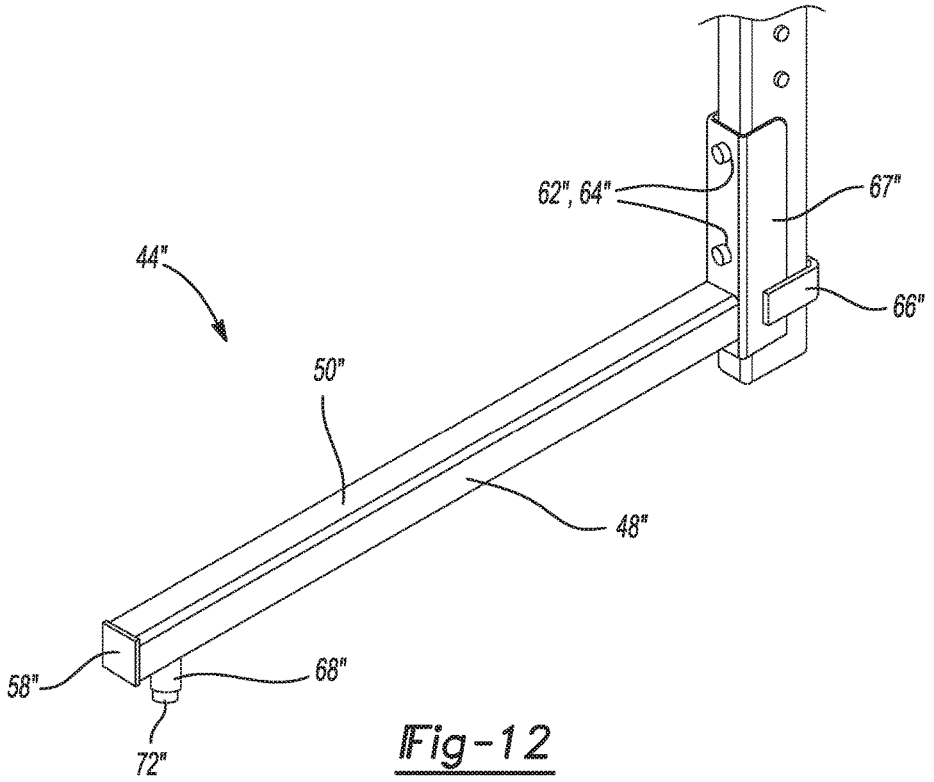
FIG. 12 shows a partial perspective view of an alternative base support for the cantilever shelving system according to the principles of the present disclosure.
Figure 13:
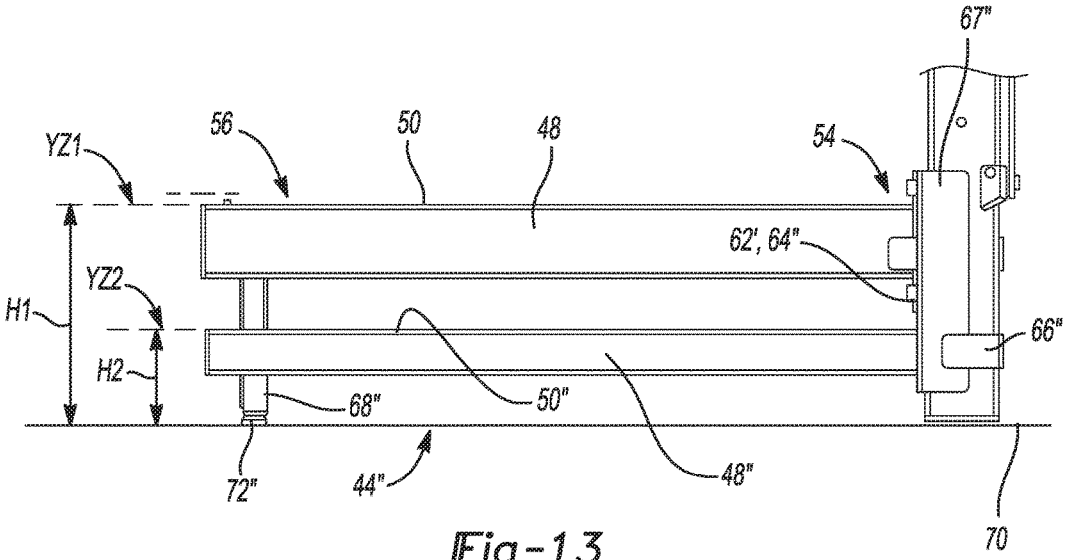
FIG. 13 shows a partial side view of the alternative base support of FIG. 12.

With reference to FIGS. 12 and 13, an alternative embodiment of a base support 44" is shown. As illustrated in FIGS. 12 and 13, the base support 44" includes both a mounting strap 66" and a mounting bracket 67" which can be securely connected to the vertical support post 16 by fasteners 64" passing mounting through apertures 62" in the mounting bracket 67".

One or more base shelves 46 can also be included in the base 20. A base shelf 46 can be positioned on or between adjacent base supports 44. Alternatively, a base shelf 46 can span more than two base supports 44. The base shelf 46 can be fixedly attached to two or more of the base supports 44. In addition to providing a lower storage space for the cantilever shelving system 1, the one or more base shelves 46 can add to the rigidity of the base 20 and the frame structure 10 when securely fastened to the base supports 44.

The base shelf 46 can include a construction of cross members 74 fixedly connected to one another, such as in a rectangular framework. A support surface 76 can be attached to an upper side of the framework. In one aspect, the support surface 76 can include a wire rack. In other aspects, the support surface can include a panel.

Figure 6:
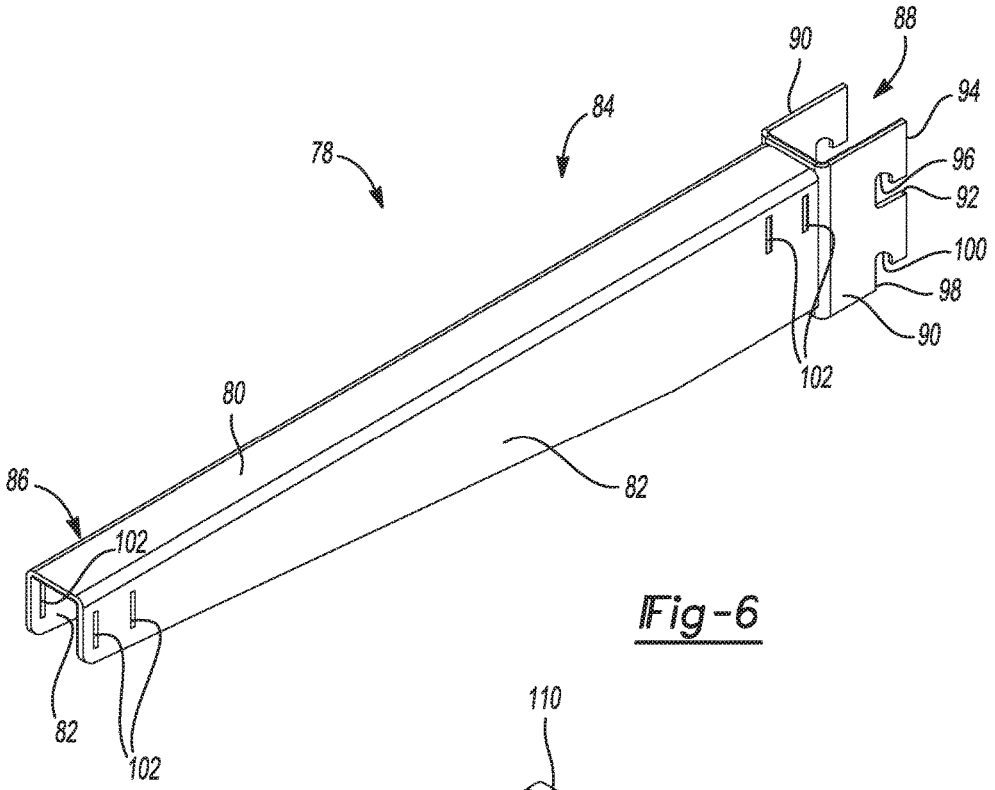
FIG. 6 is a perspective view of an exemplary horizontal cantilever support arm for the cantilever shelving system according to the principles of the present disclosure.
Figure 7:
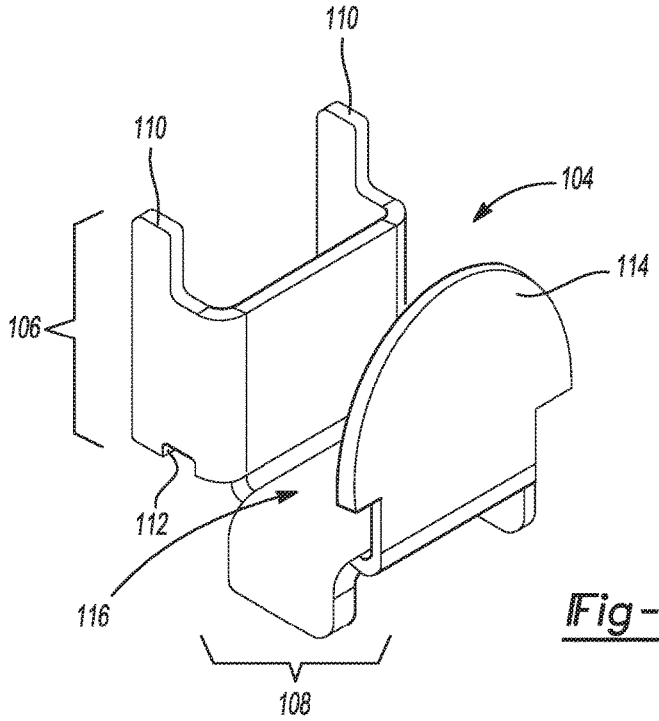
FIG. 7 is a perspective view of a shelf support fitting for the cantilever shelving system according to the principles of the present disclosure.

Referring to FIGS. 5-8, the cantilever shelf support structure 12 of the cantilever shelving system 1 of the present disclosure can be understood. The cantilever shelf support structure 12 can include a plurality of horizontally extending cantilever support arms 78. As best shown in FIG. 6, an exemplary cantilever support arm 78 can comprise an elongated downwardly open channel having a planar upper wall 80 and opposing planar side walls 82. The cantilever support arms 78 can extend from a proximal end 84 to a distal end 86 along a longitudinal axis Z2. The side walls 82 of the cantilever support arms 78 can be tapered, narrowing from the proximal end 84 to the distal end 86.

A mounting flange 88 can be integrally formed with or attached to the proximal end 84 of the cantilever support arm 78. The mounting flange 88 can include opposing side braces 90 that are spaced laterally apart to enable the mounting flange 88 to closely fit on, over or around the opposing lateral sides 26 of a vertical support post 16. Each of the side braces 90 can include at least a first open slot 92 extending to a rear end 94 of the mounting flange 88. The first open slot 92 can terminate in an offset portion 96. Additionally, each of the side braces 90 can also include a second open slot 98 having a terminal end 100. The second open slot 98 can be offset from the first open slot 92. In one aspect, the second open slot 98 is vertically aligned with and positioned below the offset portion 96 of the first open slot 92. The first and second open slots 92, 98 can be sized to accommodate and engage with the hanger pins 30 on the vertical support posts 16.

At least two elongated apertures or narrow slots 102 can be included in each of the side walls 82 of the cantilever support arm 78. At least one narrow slot 102 can be included near the proximal end 84 of the cantilever support arm 78, and at least one narrow slot 102 near the distal end 86 of the cantilever support arm 78. In one aspect, a pair of vertically extending and generally parallel narrow slots 102 can be included near each of the proximal and distal ends 84, 86 of each of the side walls 82 of the cantilever support arm 78, as shown in FIG. 6.

The cantilever shelf support structure 12 can also include a plurality of shelf support fittings 104. The shelf support fittings 104 can be adapted to attach to the cantilever support arms 78 by way of the narrow slots 102 in the side walls 82 of the cantilever support arms 78 as best seen in FIG. 5. Each shelf support fitting 104 can include a mounting portion 106 and a support portion 108. The mounting portion 106 can include at least one mounting tab 110 at an upper end and at least one lock notch 112 at a lower end. The mounting tab 110 can engage an inside surface of the side wall 82 of the cantilever support arm 78 above the narrow slot 102 and the lock notch 112 can engage a lower end of the narrow slot 102 when the shelf support fitting 104 is attached to the cantilever support arm 78.

The support portion 108 of the shelf support fitting 104 can be positioned adjacent to and offset from a lower end of the mounting portion 106. The support portion 104 can include an upward projection 114 at an outer end of the support portion 108 that is offset from the mounting portion 106 by a horizontal base 116. The projection 114 can be adapted to engage a load-bearing shelf 14.

FIGS. 1, 2, 5 and 8 show exemplary load bearing shelves 14 for use in the cantilever shelving system 1 of the present disclosure. The shelves 14 can be generally rectangular in shape and provide a load-bearing upper support structure or surface 118. The shelves 14 can include, for example, wire shelves and panel shelves well-known in the art having standard length dimensions, e.g., 24, 30, 36, 42, 48, 60 and 72 inches. Each shelf 14 can include a shelf mounting collar 120 at or near each of the four corners of the shelf 14. The shelf mounting collar 120 can be a generally hollow cylinder having an open lower end and a closed upper end. The shelf mounting collar 120 can engage the projection 114 and base 116 of the support portion 108 of the shelf support fitting 104 to attach the shelf 14 to the cantilever support arm 78. Suitable load-bearing shelves 14 that can be used in the cantilever shelving system 1 of the present disclosure are available from InterMetro Industries Corporation, the assignee of the present application, under the Super Erecta Shelf® product line.

Figure 8:
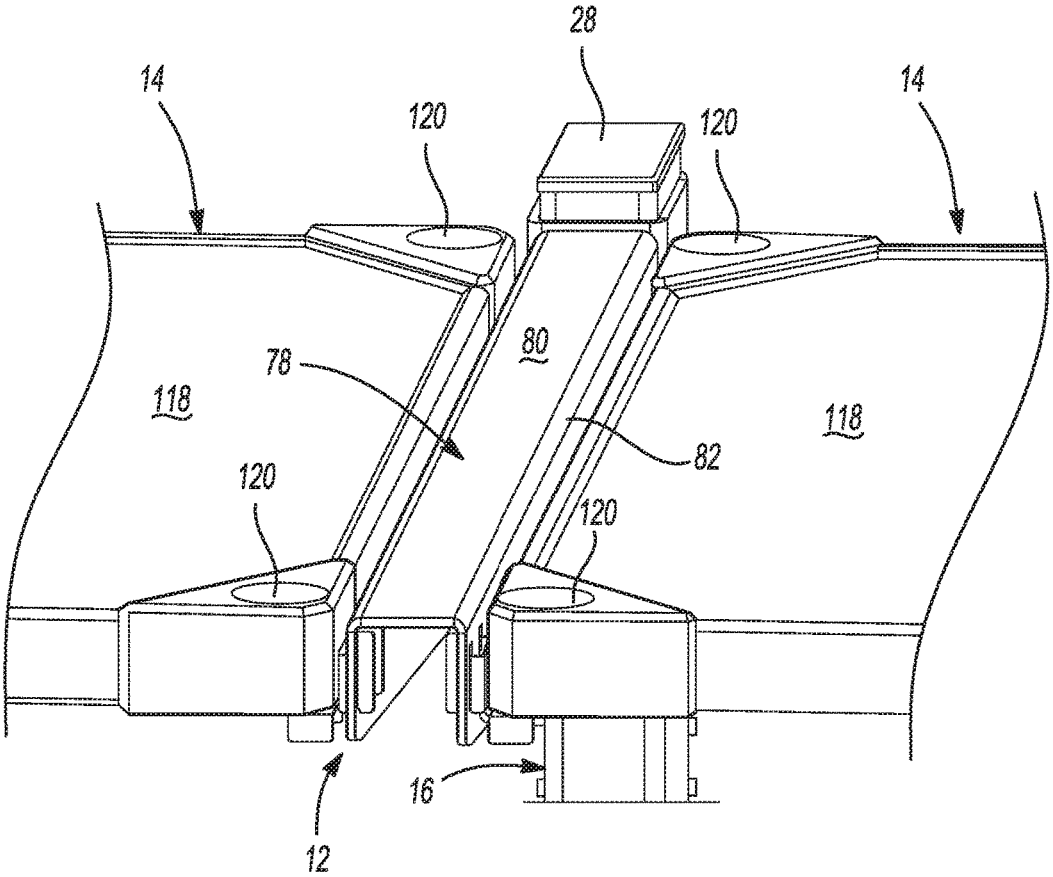
FIG. 8 shows a partial perspective view of a portion of two adjacent load-bearing shelves of the cantilever shelving system of the present disclosure.

The cantilever support arms 78 can be attached to the vertical support posts 16, as best illustrated in FIGS. 5 and 8. The mounting flange 88 of the cantilever support arm 78 can slide over lateral sides 26 of the vertical support post 16. The mounting flange 88 can slide horizontally past the hanger pins 30 which can then engage the first and second open slots 92, 98 in the braces 90 of the mounting flange 88. When the proximal end 84 of the cantilever support arm 78 abuts the front side 22 of the vertical support post 16, the cantilever support arm 78 and mounting flange 88 can slide vertically downwardly so that the hanger pins 30 can simultaneously engage or abut against the offset portion 96 of the first open slot 92 and the terminal end 100 of the second open slot 98. Thus, the cantilever support arm 78 is attached to the vertical support post 16 in a cantilevered manner.

A load-bearing shelf 14 as previously described can then be installed between two adjacent cantilever support arms 78. The shelf 14 can be lowered between the cantilever support arms 78 so that the shelf mounting collars 120 engage corresponding shelf support fittings 104 attached to the cantilever support arms 78. Thus, as illustrated in FIGS. 5 and 8, in the cantilever shelving system 1 of the present disclosure, the shelf 14 can be located adjacent to the cantilever support arm 78 and the end 124 of the shelf 14 does not overlap with the front side 22 of the vertical support post 16. As best shown in FIG. 8, the upper support surfaces 118 of the adjacent load-bearing shelves 14 can be coplanar. Moreover, the upper wall 80 of the cantilever support arm 78 is also coplanar with the support surfaces 118 of the adjacent shelves 14. Therefore, the cantilever support arm 78 of the cantilever shelving system 1 of the present disclosure can provide a continuous and smooth transition surface between adjacent shelves 14.

Referring again to FIGS. 1, 2 and 8, the cantilever shelving system 1 of the present disclosure, and particularly arrangement of the cantilever shelf supporting structure 12, can enable the width dimension W1 between adjacent portions of the frame structure 10, including the vertical support posts 16 and base supports 44, to be at least the same value as the length dimension of the shelf 14. For example, when a 36 inch shelf is installed in the cantilever shelving system 1 of the present disclosure, the width dimension W1 between the adjacent portions of the frame structure 10 can be at least 36 inches. This feature is unlike prior known cantilever shelving systems. In prior known cantilever shelving systems, the width dimension between adjacent portions of the frame supporting a shelf is less than the length dimension of the shelf. This is because prior known supporting structure for mounting the shelf to the frame is located directly beneath the shelf or that structure forms part of the shelf, itself.

It can be appreciated that the cantilever shelving system 1 of the present disclosure provides significant advantages for adapting and/or modifying the cantilever shelving system 1 to accommodate various user requirements over known shelf systems. In addition, the cantilever shelving system 1 of the present disclosure can easily be operably integrated with standard industrial and/or commercial machinery or equipment with which the cantilever shelving system 1 may be associated during use.

Figure 10:
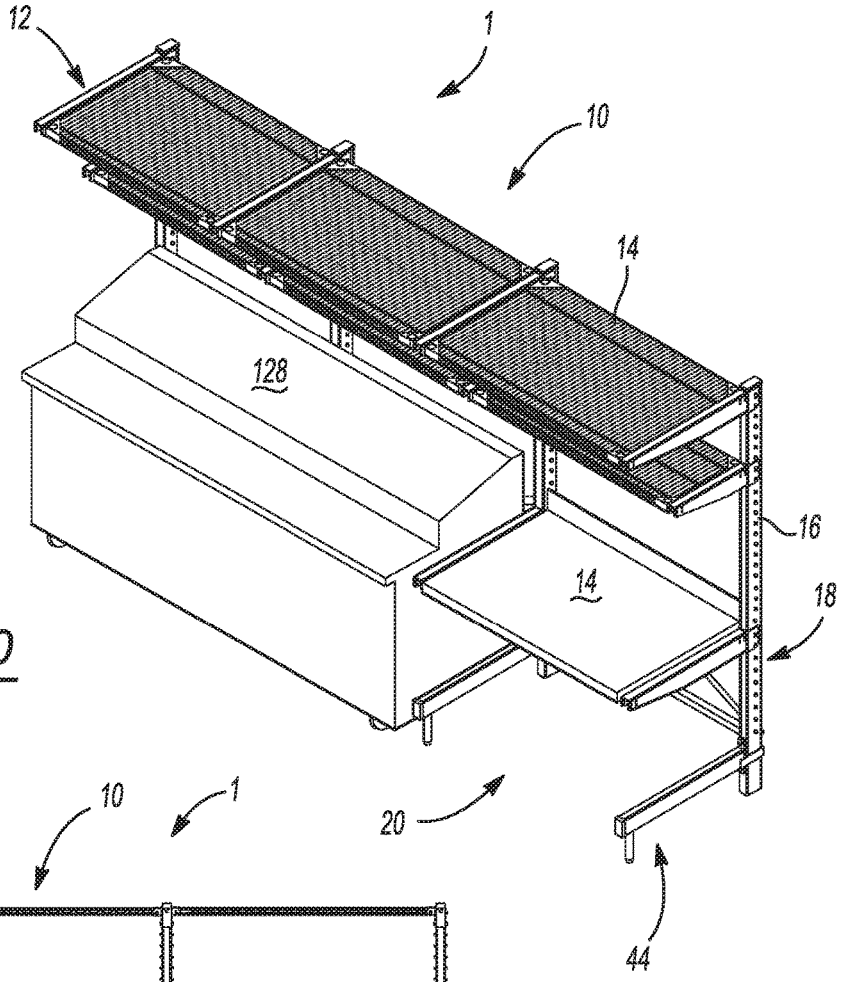
FIG. 10 shows a perspective view of the cantilever shelving system of FIG. 9 and including a piece of equipment operably integrated therewith.

For example, common commercial kitchen equipment 126 can have standard dimensions corresponding to the dimensions of known standard-sized shelves. In FIG. 2, a standard piece of kitchen equipment 126 is shown having a standard width dimension. The equipment 126 can be operably integrated with the cantilever shelving system 1 and located in the space created in the frame structure 10, between two of the vertical support posts 16 and corresponding base supports 44 and beneath the standard length shelves 14. As another example, a standard-wide piece of kitchen equipment 128 can be operably integrated with a cantilever shelving system 1 including a low-profile base support 44', as shown in FIGS. 9-11. The wide equipment 128 can, for example be moveable on casters 130 which can raise the base 132 of the equipment 128 about four to six inches above the floor 70. The base 132 of the wide equipment 128 can pass over the low-profile base support 44' and can be located in the space created in the frame structure 10 between the vertical support posts 16 and corresponding base supports 44 and beneath the standard length shelves 14.

Additionally, it can also be appreciated from FIGS. 1, 2, and 9, that the cantilever shelving system 1 can incorporate a plurality of shelves 14, and the shelves 14 can have a plurality of different length and width dimensions. Further, it can be appreciated that the cantilever shelving system 1 can be constructed and/or modified (e.g., widened or narrowed) simply and easily by adding or removing portions of the frame structure 10 (e.g., vertical support posts 16 and base supports 44, 44').

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cantilever shelving system of the type that is free-standing on a floor surface, the cantilever shelving system comprising:

a frame comprising a plurality of laterally-spaced, vertically-oriented support members;

a cantilever shelf support mounted to the frame, the cantilever shelf support comprising:

a plurality of horizontally extending cantilever support arms each comprising a planar upper wall and at least one planar side wall; and a plurality of shelf supports connected to each planar side wall respectively; at least one shelf supported by a corresponding shelf support from said shelf supports and the frame, the at least one shelf comprising a planar upper side; and a plurality of base supports adapted to engage the floor surface, wherein each of the plurality of base supports is connected to a corresponding one of the plurality of support members;

wherein each of the plurality of base supports comprises a support leg having an upper side that extends away from each of the corresponding one of the plurality of support members;

wherein the plurality of base supports comprises two first base supports separated by a lateral distance and at least one second base support located intermediate the two first base supports;

wherein the respective upper sides of the support legs of the two first base supports are a first height vertically above the floor surface; and wherein the upper side of the at least one second base support is a second height vertically above the floor surface;

wherein the second height is less than the first height;

wherein the cantilevered shelving system is configured to integrate a piece of kitchen equipment such that a width dimension of the piece of kitchen equipment is disposed between the two first base supports and a base of the piece of kitchen equipment is disposed over the upper side of the at least one second base support;

wherein in an assembled state of the cantilever shelving system the planar upper walls of two cantilever support arms from said plurality of cantilevered support arms are located laterally adjacent to the at least one shelf;

wherein the planar upper walls of the two cantilever support arms are generally coplanar with the planar upper side of the at least one shelf; wherein each cantilever support arm further comprises: an elongated portion extending from a proximal end that is adjacent to the corresponding one of the plurality of support members to a distal end along a longitudinal axis; and at least two slots in the at least one planar side wall, wherein at least one slot of the at least two slots is near the proximal end of the elongated portion and at least one slot of said at least two slots is near the distal end of the elongated portion; wherein each shelf support comprises: a mounting portion comprising at least one mounting tab; and a support portion laterally offset from the mounting portion;

wherein in an assembled state of the cantilever shelving system the at least one mounting tab of the mounting portion of each shelf support is inserted into a corresponding one of the at least two slots of a corresponding cantilever support arm and engages an interior surface of the at least one planar side wall of the corresponding cantilever support arm at a location above the corresponding one of the at least two slots; and wherein in an assembled state of the cantilever shelving system the support portion of the mounting portion of each shelf support engages the at least one shelf.

2. The cantilever shelving system of claim 1, wherein each of the plurality of base supports is connected to a corresponding one of the plurality of support members near a lower vertical end of each corresponding one of the plurality of support members;

wherein each support leg extends from a proximal end to a distal end along a longitudinal axis that forms an angle of approximately ninety degrees with each corresponding one of the plurality of support members respectively.

3. The cantilever shelving system of claim 2, wherein the first height is between about 6 inches and about 10 inches; and wherein the second height is between about 3 inches and about 5 inches.

4. The cantilever shelving system of claim 1, wherein each support leg extends from a proximal end to a distal end along a longitudinal axis;

wherein each base support of the plurality of base supports further comprises a flange connected to the proximal end of each of the support legs respectively;

wherein each flange is positioned adjacent to a front side of each corresponding one of the plurality of support members respectively; and wherein each flange is connected to each corresponding one of the plurality of support members respectively.

5. The cantilever shelving system of claim 4, wherein each flange extends at least one of above or below each support leg respectively.

6. The cantilever shelving system of claim 5, wherein each flange includes at least one mounting aperture for accommodating at least one fastener for connecting each flange to each corresponding one of the plurality of support members respectively.

7. The cantilever shelving system of claim 4, wherein each flange extends both above and below each support leg respectively.

8. The cantilever shelving system of claim 7, wherein each flange includes a plurality of mounting apertures for respectively accommodating a corresponding plurality of fasteners for connecting each flange to each corresponding one of the plurality of support members respectively.

9. The cantilever shelving system of claim 4, wherein each base support of the plurality of base supports further comprises at least one mounting strap connected to the proximal end of each support leg;

wherein each mounting strap is positioned adjacent to at least one lateral side of each corresponding one of the plurality of support members respectively.

10. The cantilever shelving system of claim 9, wherein: each mounting strap is positioned adjacent to two lateral sides of each corresponding support member respectively.

11. The cantilever shelving system of claim 9, wherein: each mounting strap is positioned adjacent to two lateral sides and a back side of each corresponding one of the plurality of support members respectively.

12. The cantilever shelving system of claim 4, wherein each base support of the plurality of base supports further comprises two mounting straps, each mounting strap connected to the proximal end of each support leg and positioned adjacent to a respective lateral side of each corresponding one of the plurality of support members respectively.

13. The cantilever shelving system of claim 12, wherein: each mounting strap is connected to each corresponding one of the plurality of support members respectively.

14. The cantilever shelving system of claim 4, wherein: each base support of the plurality of base supports further comprises a support foot located near the distal end of each support leg;

wherein each support foot extends from each support leg to the floor surface respectively.

15. The cantilever shelving system of claim 14, wherein: each support foot comprises a bolt leveler.

16. The cantilever shelving system of claim 1, wherein each support leg of the plurality of base supports extends from a proximal end to a distal end along a longitudinal axis;

wherein each base support of the plurality of base supports further comprises a mounting bracket connected to the proximal end of each support leg respectively;

wherein each mounting bracket is positioned adjacent to both a front side and a lateral side of each corresponding one of the plurality of support members respectively; and wherein each mounting bracket is connected to each corresponding one of the plurality of support members respectively.

17. The cantilever shelving system of claim 16, wherein: wherein each mounting bracket includes at least one mounting aperture for accommodating at least one fastener for connecting each mounting bracket to each corresponding one of the plurality of support members respectively.

18. The cantilever shelving system of claim 16, wherein:

each mounting bracket extends both above and below each support leg respectively.

19. The cantilever shelving system of claim 16, wherein: wherein each mounting bracket includes a plurality of mounting apertures for respectively accommodating a corresponding plurality of fasteners for connecting each mounting bracket to each corresponding one of the plurality of support members respectively.

20. The cantilever shelving system of claim 16, wherein:

each base support of the plurality of base supports further comprises a support foot located near the distal end of each support leg;

wherein each support foot extends from each support leg to the floor surface respectively.

21. The cantilever shelving system of claim 20, wherein: each support foot comprises a bolt leveler.

22. The cantilever shelving system of claim 1, wherein the at least one shelf comprises a plurality of corners and a mounting collar located near each of the plurality of corners;

wherein the support portion of the mounting portion of each shelf support comprises an upwardly extending projection; and wherein in an assembled state of the cantilever shelving system each mounting collar receives a corresponding projection.

23. The cantilever shelving system of claim 22, wherein the mounting portion of each shelf support comprises a lock notch; and wherein each lock notch engages a lower end of the one slot of the at least two slots.

24. The cantilever shelving system of claim 1, wherein each cantilever support arm further comprises a mounting flange located at the proximal end of the elongated portion and includes opposing side braces spaced laterally apart to enable each mounting flange to receive and be mounted on a corresponding support member of said plurality of support members;

wherein each of the side braces includes a first open slot extending to a rear end of each mounting flange, each first open slot terminating in an offset portion.

25. The cantilever shelving system of claim 24, wherein each of the side braces further includes a second open slot having a terminal end; and wherein each second open slot is below each first open slot respectively.

26. The cantilever shelving system of claim 25, wherein each of the support members comprises a plurality of vertically spaced-apart hanger pins that extend outwardly from one or both opposing lateral sides of the support member; and wherein the first and second open slots are sized to accommodate and engage the hanger pins.

27. The cantilever shelving system of claim 26, wherein the frame further comprises a lateral support interconnecting at least two support members from said plurality of support members.

* * * * *